United States Patent [19]

DeBolt et al.

[11] Patent Number: 5,049,944

[45] Date of Patent: Sep. 17, 1991

[54] METHOD AND APPARATUS FOR CONTROLLING THE APPLICATION OF A FUSER RELEASE AGENT

[75] Inventors: Frederick C. DeBolt, Penfield; Kenneth R. Rasch, Webster; Barry G. Rickett, Pittsford; Mark T. Miller, Rochester, all of N.Y.

[73] Assignee: Xerox Corporation, Stamford, Conn.

[21] Appl. No.: 334,415

[22] Filed: Apr. 7, 1989

[51] Int. Cl.[5] ..... G03G 15/20; G03G 21/00

[52] U.S. Cl. ..... 355/284

[58] Field of Search ..... 355/282, 284, 290, 295, 355/300; 219/216

[56] References Cited

U.S. PATENT DOCUMENTS

| | | | |
|---|---|---|---|
| 3,526,457 | 9/1970 | Dimond et al. | 355/300 |
| 3,672,764 | 6/1972 | Hartwig et al. | 355/300 |
| 3,941,558 | 3/1976 | Takiguchi | 432/60 |
| 4,393,804 | 7/1983 | Nygard et al. | 118/60 |
| 4,557,588 | 12/1985 | Tomosada | 355/300 |
| 4,935,785 | 6/1990 | Wildi et al. | 355/290 |
| 4,939,552 | 7/1990 | Nakanishi | 355/300 |
| 4,949,130 | 8/1990 | Torino | 355/282 |

*Primary Examiner*—Fred L. Braun

*Attorney, Agent, or Firm*—Ronald F. Chapuran

[57] ABSTRACT

Apparatus and method for applying offset preventing liquid to a fuser roll including an oil impregnated web member adapted to be moved by a motor from a supply core to a take up core; and a control to vary the duty cycle operation of the motor to drive the web member at a relatively constant liner speed at a contact nip, the control including a timer to monitor the cumulative time of operation of the motor and to progressively decrease the duty cycle of the motor in response to the cumulative time of operation wherein the progressively decreased duty cycle of operation compensates for the increasing radius of the web member on the take up core to maintain the relatively constant linear speed at the contact nip.

12 Claims, 4 Drawing Sheets

METHOD AND APPARATUS FOR CONTROLLING THE APPLICATION OF A FUSER RELEASE AGENT

CROSS REFERENCE TO RELATED APPLICATIONS

Reference is made to the following copending applications filed concurrently herewith: Application Ser. No. 07/334,416, now U.S. Pat. No. 4,929,983, entitled "STRIPPER MECHANISM" in the name of Barton et al.; Application Ser. No. 07/334,414, entitled "FUSER APPARATUS" in the name of DeBolt et al.; and Application Ser. No. 07/334,413, now abandoned, entitled "STRIPPER MECHANISM FOR REMOVING COPY SUBSTRATES FROM A SOFT ROLL FUSER" in the name of Paul M. Fromm.

BACKGROUND OF THE INVENTION

The present invention relates to fuser apparatus for electrostatographic printing machines and in particular to a roll fuser release agent delivery method.

In electrostatographic reproducing apparatus commonly used today, a photoconductive insulating member is typically charged to a uniform potential and thereafter exposed to a light image of an original document to be reproduced. The exposure discharges the photoconductive insulating surface in exposed or background areas and creates an electrostatic latent image on the member which corresponds to the image contained within the original document. Alternatively, a light beam may be modulated and used to selectively discharge portions of the charged photoconductive surface to record the desired information thereon. Typically, such a system employs a laser beam. Subsequently, the electrostatic latent image on the photoconductive insulating surface is made visible by developing the image with developer powder referred to in the art as toner. Most development systems employ developer which comprises both charged carrier particles and charged toner particles which triboelectrically adhere to the carrier particles. During development, the toner particles are attracted from the carrier particles by the charged pattern of the image areas of the photoconductive insulating area to form a powder image on the photoconductive area. This toner image may be subsequently transferred to a support surface such as copy paper to which it may be permanently affixed by heating or by the application of pressure or a combination of both.

In order to fix or fuse the toner material onto a support member permanently by heat, it is necessary to elevate the temperature of the toner material to a point at which constituents of the toner material coalesce and become tacky. This action causes the toner to flow to some extent onto the fibers or pores of the support members or otherwise upon the surfaces thereof. Thereafter, as the toner material cools, solidification of the toner material occurs causing the toner material to be bonded firmly to the support member.

One approach to thermal fusing of toner material images onto the supporting substrate has been to pass the substrate with the unfused toner images thereon between a pair of opposed roller members at least one of which is internally heated. During operation of a fusing system of this type, the support member to which the toner images are electrostatically adhered is moved through the nip formed between the rolls with the toner image contacting the fuser roll thereby to affect heating of the toner images within the nip. Typical of such fusing devices are two roll systems wherein the fusing roll is coated with an abhesive material, such as a silicone rubber or other low surface energy elastomer or, for example, tetrafluoroethylene resin sold by E. I. DuPont De Nemours under the trademark Teflon. In these fusing systems, however, since the toner image is tackified by heat it frequently happens that a part of the image carried on the supporting substrate will be retained by the heated fuser roller and not penetrate into the substrate surface. This tackified toner may stick to the surface of the fuser roll, offset to a subsequent sheet of support substrate, offset to the pressure roll when there is no sheet passing through a fuser nip resulting in contamination of the fuser roll, pressure roll and marked copies.

It has also been proposed to provide toner release agents such as silicone oil, in particular, polydimethyl silicone oil, which is applied on the fuser roll to a thickness of the order of about 1 micron to act as a toner release material. These materials posses a relatively low surface energy and have been found to be materials that are suitable for use in the heated fuser roll environment. In practice, a thin layer of silicone oil is applied to the surface of the heated roll to form an interface between the roll surface and the toner image carried on the support material. Thus, a low surface energy, easily parted layer is presented to the toners that pass through the fuser nip and thereby prevents toner from adhering to the fuser roll surface.

Various systems have been used to deliver release agent fluid to the fuser roll including the use of oil soaked rolls and wicks with and without supply sumps as well as oil impregnated webs. The oil soaked rolls and wicks generally suffer from the difficulty in that they require a sump of oil to replenish the roll and the wick as its supply of release agent is depleted by transfer to the fuser roll. Furthermore, a wick suffers from the difficulty of a relatively short life of the order of around 10,000 prints. Furthermore, these systems suffer from the further difficulty in that their surfaces in contact with the fuser roll are constant whereby contamination particularly by toner and paper can readily occur further reducing valuable life. The web systems, on the other hand, generally suffer from the difficulty in uniformly contacting the fuser roll to consistently apply the release agent fluid. In addition, the web systems are often complex, relatively expensive, mechanical arrangements including extra rolls and mechanical linkage.

PRIOR ART

U.S. Pat. No. 3,941,558 to Takiguchi discloses a rolled web impregnated with silicone oil for preventing offset. The web has a thickness of two mm, a total length of 50 cm, and travels one cm per thousand copies between the supply and take-up rollers. This system transfers about 0.003 cc of oil to the fuser per copy.

U.S. Pat. No. 4,393,804 to Nygard et al. discloses a rolled web system that moves between a supply core and take-up roller. A felt applicator supplies oil from a supply reservoir to the web. The take-up core is driven by a slip clutch at a speed greater than the speed of the pressure roller, thus exerting tension on the web. The web is between one and two mm in thickness and moves at a constant speed of five cm per 200 to 1,000 copies.

In addition, there are several automatic printing machines commercially available. For example, the Canon 3225, 3725, 3000 series, 4000 series and 5000 series products all have liquid release agent impregnated webs supported between a supply roll and a take-up roll and urged into contact with the fuser roll by an open celled foam pinch roll.

It is an object of the present invention, therefore, to provide a new and improved release agent control for an oil impregnated web wound up on take up and supply shafts. It is another object of the present invention to provide a control that varies the speed of the web drive in relation to the diameter of the web on a take-up shaft. It is another object of the present invention to provide a control that varies the duty cycle of the web drive to uniformly provide release agent to a fuser roll. Further advantages of the present invention will become apparent as the following description proceeds and the features characterizing the invention will be pointed out with particularly in the claims annexed to and forming a part of this specification.

SUMMARY OF THE INVENTION

Briefly, the present invention is apparatus for applying offset preventing liquid to a fuser roll including a supply core; a rotatable take up core; an oil impregnated web member adapted to be moved from the supply core to the take up core; a motor mechanically coupled to the take up roll for driving the web member from the supply core to the take up core; a pressure roll in engagement with the web member and positioned to provide a contact nip for the web member with the fuser roll opposite the pressure roll wherein the contact of the web member with the fuser roll transfers oil from the web member to the fuser roll, and control means to vary the duty cycle operation of the motor to drive the web member at a relatively constant linear speed at the contact nip, the control means including a timer to monitor the cumulative time of operation of the motor and means to progressively decrease the duty cycle of the motor in response to the cumulative time of operation wherein the progressively decreased duty cycle of operation compensates for the increasing radius of the web member on the take up roll to maintain said relatively constant linear speed at the contact nip.

For a better understanding of the present invention, reference may be had to the accompanying drawings wherein the same reference numerals have been applied to like parts and wherein:

DESCRIPTION OF THE PREFERRED EMBODIMENT

Figure 1:
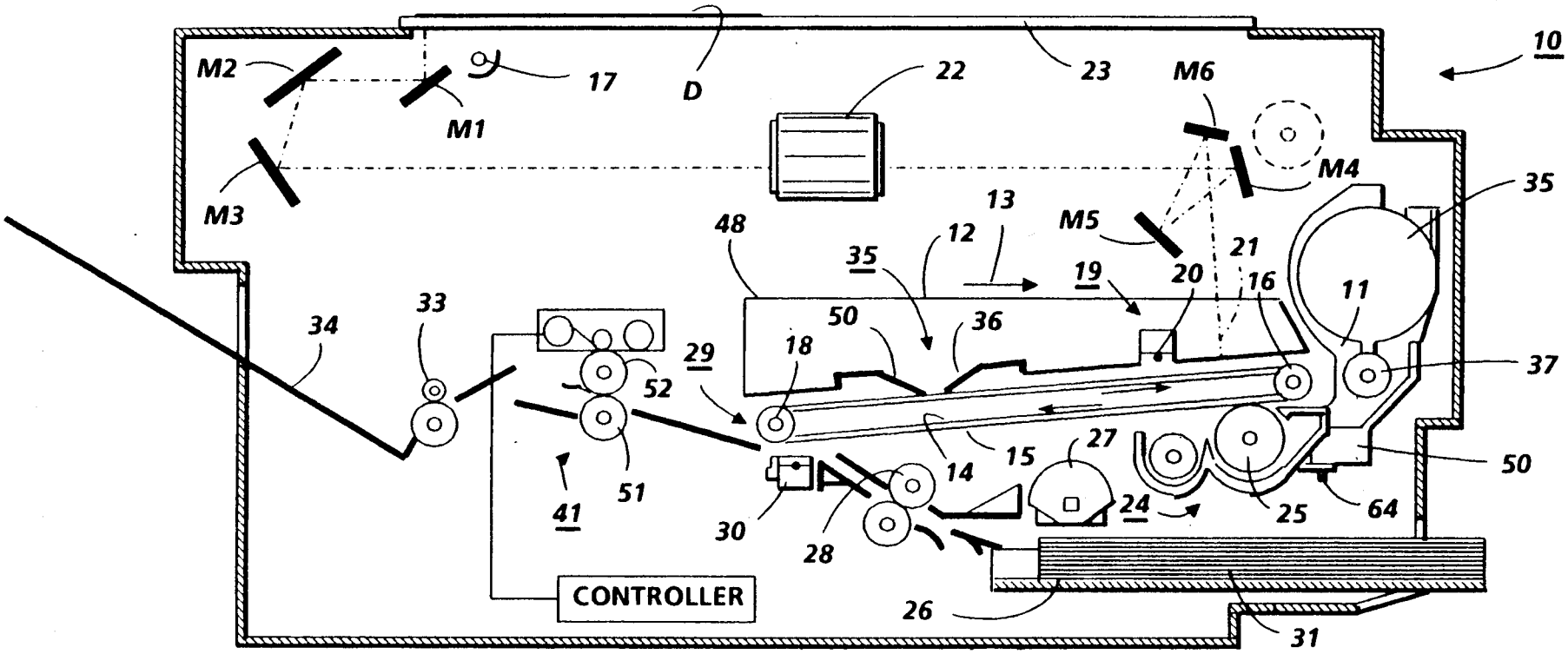
FIG. 1 is a schematic representation in cross-section of an automatic electrostatographic printing machine with a fuser apparatus incorporating the present invention.

Referring now to FIG. 1, there is shown by way of example, an automatic electrostatographic reproducing machine 10 which includes a fuser apparatus according to the present invention. The reproducing machine depicted in FIG. 1 illustrates the various components utilized therein for producing copies from an original document. Although the apparatus of the present invention is particularly well adapted for use in automatic electrostatographic reproducing machines, it should become evident from the following description that it is equally well suited for use in a wide variety of processing systems including other electrostatographic systems and is not necessarily limited in application to the particular embodiment or embodiment shown herein.

The reproducing machine 10 illustrated in FIG. 1 employs a removable processing cartridge 12 which may be inserted and withdrawn from the main machine frame in the direction of arrow 13. Cartridge 12 includes an image recording belt like member 14 the outer periphery of which is coated with a suitable photoconductive material 15. The belt is transport roll 16, around idler roll 18 and travels in the direction indicated by the arrows on the inner run of the belt to bring the image bearing surface thereon past the plurality of xerographic processing stations. Suitable drive means such as a motor, not shown, are provided to power and coordinate the motion of the various cooperating machine components whereby a faithful reproduction of the original input scene information is recorded upon a sheet of final support material 31, such as paper or the like.

Initially, the belt 14 moves the photoconductive surface 15 through a charging station 19 wherein the belt is uniformly charged with an electrostatic charge placed on the photoconductive surface by charge corotron 20 in known manner preparatory to imaging. Thereafter, the belt 14 is driven to exposure station 21 wherein the charged photoconductive surface 15 is exposed to the light image of the original input scene information, whereby the charge is selectively dissipated in the light exposed regions to record the original input scene in the form of electrostatic latent image.

The optical arrangement creating the latent image comprises a scanning optical system with lamp 17 and mirrors $M_1$, $M_2$, $M_3$ mounted to a a scanning carriage (not shown) to scan the original document D on the imaging platen 23, lens 22 and mirrors $M_4$, $M_5$, $M_6$ to transmit the image to the photoconductive belt in known manner. The speed of the scanning carriage and the speed of the photoconductive belt are synchronized to provide faithful reproduction of the original document. After exposure of belt 14 the electrostatic latent image recorded on the photoconductive surface 15 is transported to development station 24, wherein developer is applied to the photoconductive surface 15 of the belt 14 rendering the latent image visible. The development station includes a magnetic brush development system including developer roll 25 utilizing a magnetizable developer mix having course magnetic carrier granules and toner colorant particles as will be discussed in greater detail hereinafter.

Sheets 31 of the final support material are supported in a stack arranged on elevated stack support tray 26. With the stack at its elevated position, the sheet separator segmented feed roll 27 feeds individual sheets therefrom to the registration pinch roll pair 28. The sheet is then forwarded to the transfer station 29 in proper registration with the image on the belt and the developed image on the photoconductive surface 15 is brought into contact with the sheet 31 of final support material within the transfer station 29 and the toner image is transferred from the photoconductive surface 15 to the contacting side of the final support sheet 31 by means of transfer corotron 30. Following transfer of the image, the final support material which may be paper, plastic, etc., as desired, is separated from the belt by the beam strength of the support material 31 as it passes around the idler roll 18, and the sheet containing the toner image thereon is advanced to fixing station 41 wherein roll fuser 52 fixes the transferred powder image thereto. After fusing the toner image to the copy sheet 31 is advanced by output rolls 33 to sheet stacking tray 34.

Although a preponderance of toner powder is transferred to the final support material 31, invariably some residual toner remains on the photoconductive surface 15 after the transfer of the toner powder image to the final support material. The residual toner particles remaining on the photoconductive surface after the transfer operation are removed from the belt 14 by the cleaning station 35 which comprises a cleaning blade 36 in scrapping contact with the outer periphery of the belt 14 and contained within cleaning housing 48 which has a cleaning seal 50 associated with the upstream opening of the cleaning housing. Alternatively, the toner particles may be mechanically cleaned from the photoconductive surface by a cleaning brush as is well known in the art.

It is believed that the foregoing general description is sufficient for the purposes of the present application to illustrate the general operation of an automatic xerographic copier 10 which can embody the apparatus in accordance with the present invention.

Figure 2:
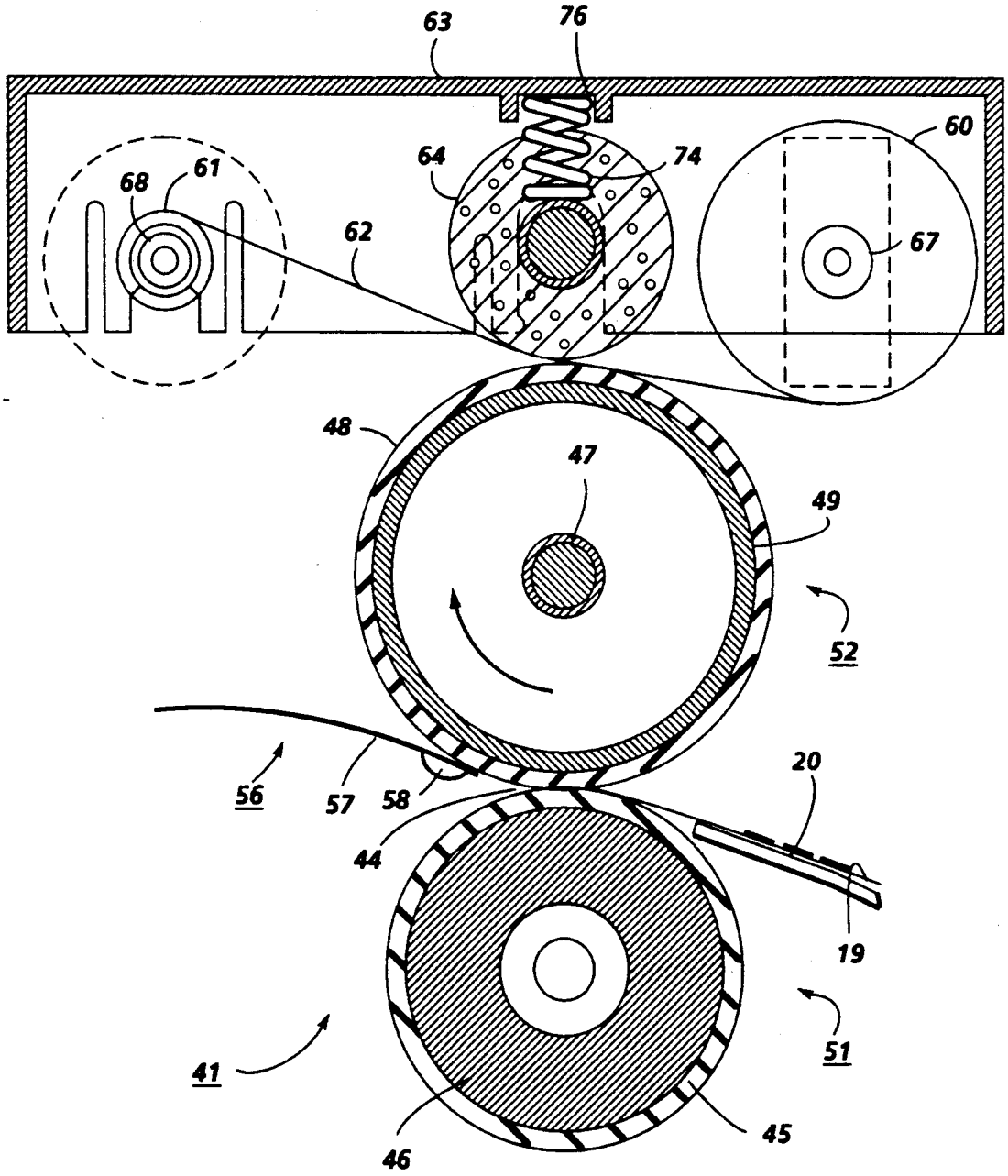
FIG. 2 is an enlarged view in cross-section of the fuser apparatus of FIG. 1.
Figure 3:
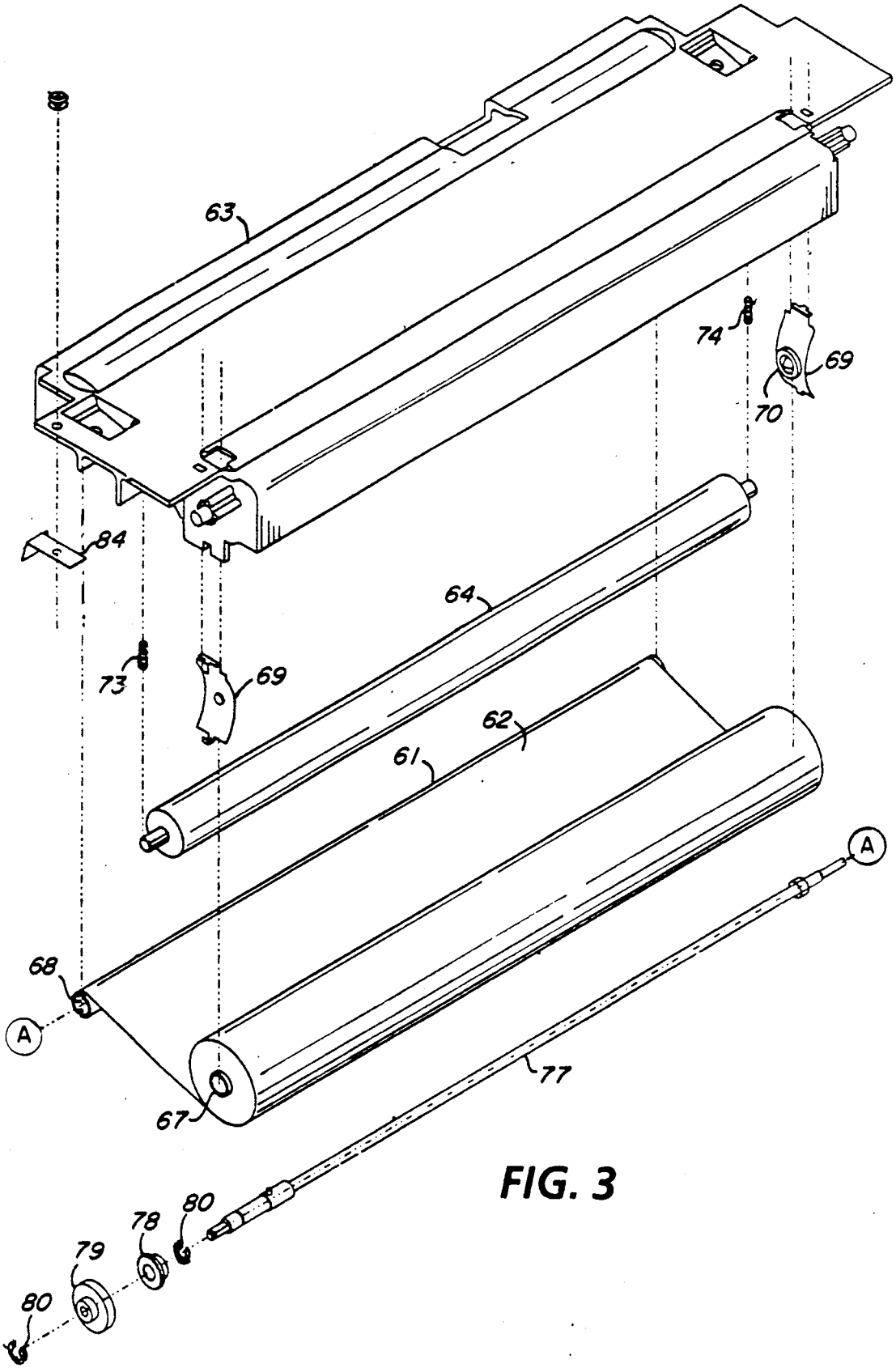
FIG. 3 is an exploded isometric view of the release agent management apparatus of FIG. 1.

Attention is now directed to FIGS. 2 and 3 wherein the fuser apparatus is described in greater detail. As shown in FIG. 2, the fuser roll 52 is composed of a core 49 having coated thereon a thin layer 48 of an elastomer. The core 49 may be made of various metals such as iron, aluminum, nickel, stainless steel, etc., and various synthetic resins. Aluminum is preferred as the material for the core 49, although this is not critical. The core 49 is hollow and a heating element 47 is generally positioned inside the hollow core to supply the heat for the fusing operation. Heating elements suitable for this purpose are known in the prior art and may comprise a quartz heater made of a quartz envelope having a tungsten resistance heating element disposed internally thereof. The method of providing the necessary heat is not critical to the present invention, and the fuser member can be heated by internal means, external means or a combination of both. All heating means are well known in the art for providing sufficient heat to fuse the toner to the support. The thin fusing elastomer layer may be made of any of the well known materials such as the RTV and HTV silicone elastomers.

The fuser roll 52 is shown in a pressure contact arrangement with a backup or pressure roll 51. The pressure roll 51 comprises a metal core 46 with a layer 45 of a heat-resistant material. In this assembly, both the fuser roll 52 and the pressure roll 51 are mounted on bearings (not shown) which are biased so that the fuser roll 52 and pressure roll 51 are pressed against each other under sufficient pressure to form a nip 44. It is in this nip that the fusing or fixing action takes place. The layer 45 may be made of any of the well known materials such as fluorinated ethylene propylene coplymer or silicone rubber.

The liquid release agent delivery system or release agent management system comprises a housing 63 which may typically be a one-piece plastic molded member having mounting elements such as slots or holes for each of the web supply roll 60, the web take-up roll 61 and the open celled foam pinch roll 64. The web supply roll 60 and web take-up roll 61 are supported in the housing such that when a liquid release agent delivery system is in place, one of the supply roll 60 and take-up rolls 61 is on one side of the fuser roll 52 and the other is on the other side of the fuser roll and the movable web 62 is in contact with the fuser roll 52 along a path parallel to its longitudinal axis. In addition, the movable web 62 is urged into delivery engagement with the fuser roll by the open celled foam pinch roll 64 positioned on the side of the web 62 opposite the fuser roll 52.

The supply roll 60 and take-up roll 61 are each made from interchangeable rotatable tubular support cores 67 and 68 to enable the reversibility of the web. The supply roll core 67 has a supply of release agent impregnated web material 62 wound around the core and is tensioned within the housing to resist unwinding by means of a leaf spring 69 at each end of the housing 63 which urges the mounting collars 70 into engagement with the rotatable tubular support core 67. The foam pinch roll 64 which is also impregnated with liquid release agent is spring biased toward the fuser roll by two coil springs 73 and 74, one at each end of a pinch roll mounting slot to apply pressure between the web 62 and the fuser roll 52 to insure delivery of an adequate quantity of release agent to the fuser roll. The pinch roll 64 is impregnated with release agent which insures that any sections of the web material which may have been loaded with inadequate quantities of release agent are supplied with release agent.

The take-up roll 61 is mounted on a drive shaft 77 to advance the impregnated web from the supply roll 60 to the take-up roll 61. The driven end of the drive shaft includes a bearing 78, gear 79 and two retaining rings 80 and is driven by a dedicated motor such as an AC synchronous gear motor or clock motor. The housing has a anti-rotation clip 84 which engages the drive gear 79 on the drive shaft 77 to prevent the take-up roll shaft 77 from unwinding. The supply roll is mounted in two mounting collars 70 one on each end of the housing which are on leaf spring 69. The take-up roll has one end of the drive shaft mounted in a hole in the housing and the other drive gear end mounted in a snap fitted slot in the housing. Similarly, the pinch roll shaft is mounted in two slots.

Any suitable web material capable of withstanding fusing temperatures of the order of 225° C. may be employed. Typically, the web material is capable of being impregnated with at least 25 grams per meter square of liquid release agent. The web material may be woven or non-woven and of a sufficient thickness to provide a minimum amount of release agent for a desired life. For example, for a web material capable of holding about 30 grams of release agent per square meter, a thickness of 0.07 millimeters will provide a quantity of release agent capable of fusing about 100,000 prints. It should be understood that the principle function of the web is the delivery of the release agent and that a cleaning function wherein the fuser roll is cleaned is secondary.

The web is advanced by a clock motor driving the drive shaft through a series of reducing duty cycles to maintain a constant rate of feed of web material through the nip between the fuser roll and the foam pinch roll. Typically, this rate is of the order of 2 millimeters per minute wherein the web is advanced for a period of time beginning just before and ending just after the print enters and leaves the fuser nip. This rate web advancement of 2 millimeters per minute has been found to be satisfactory for print runs of the order of up to twenty prints per run. It has been found, however, that with longer runs beyond about twenty copies, more release agent is required. This is due to the depletion characteristics of the fuser roll rubber.

Thus, while the web may be advanced at a substantially constant rate to deliver release agent to the fuser roll at a substantially constant rate for printing runs up to about twenty prints, the controller on the printing machine may be programmed to advance the web at a greater rate when the printing run is greater than the predetermined number of prints. For example, while the web may be advanced at the rate of 2 millimeters per minute for printing runs up to twenty prints, it has been found that an increase of about 50% to 3 millimeters per minute is desirable to maintain the same level of delivery of release agent to the fuser roll. The preferred non-woven aramid web with polyester fiber binder about 0.07 millimeters thick and capable of being impregnated with at least 25 grams of release agent per square meter and 13,500 millimeters long is capable of supplying release agent for between 80,000 and 110,000 copies.

The open celled foam pinch roll may be made of any suitable material which is resistant to high temperatures of the order of the fusing temperature at 22° C. and does not take a permanent set. Typically, it is a molded silicone rubber foam with open about 0.5 millimeters in their maximum dimension.cells to enable the storage of release agent.

The liquid release agent may be selected from those materials which have been conventionally used. Typical release agents include a variety of conventional used silicone oils including both functional and non-functionally oils. Thus, the release agent is selected to be compatible with the rest of the system. A particularly preferred release agent is an unimodal low molecular weight polysiloxane having a viscosity of about 11,000 centistokes. Such a release agent when used in a release agent delivery system as described above wherein about a 0.07 millimeter thick web is impregnated with at least 25 grams per square meter of release agent and a 20 millimeter diameter open celled, silicone rubber foam roll is also impregnated with the release agent, is consumed at a rate of about 0.3 microliters per copy.

In operation, as described above, the web is advanced only during that portion of the time just prior to the print entering and just after the print leaving the fuser to deliver release agent to the fuser roll. The controller is programmed to deliver release agent to the fuser roll at a substantially constant rate up to a predetermined number of prints in a print run.

Further the controller monitors the depletion of the web, for example, by keeping track of the time the motor is running and advises the machine operator on an appropriate code on the display panel when the supply of impregnated web material on the supply roll is becoming exhausted. For example, the printing machine operator or customer could be alerted initially when there is sufficient supply of web material for only say 2,000 prints and again when there is sufficient supply for 1,000 prints remaining on the supply roll at which time appropriate steps could be taken to insure continuity of operation. As discussed previously, the movable web supply roll and take-up roll are reversibly mounted in the housing to deliver liquid release agent and when the supply of web material has or is about to become exhausted the position of the supply roll and take-up roll may be reversed so that the second side of the impregnated web is in contact with the fuser roll to deliver release agent thereto. This is facilitated by having interchangeable rotatable tubular support cores for each of the supply roll and the take-up roll which may be manually removed from the mounting, flipped over and reinserted in their reversed positions.

When the supply of impregnated web on the new supply roll (the take-up roll on the first side of the impregnated web) is or is about to be exhausted the supply roll web and take-up roll are removed and replaced with a new supply roll impregnated web and take-up roll which may be used in the same manner wherein initially a first side of the impregnated web is in contact with the fuser roll, its supply exhausted, the web is reversed and the second side of the impregnated web is placed in contact with the fuser roll to deliver release agent to it. During this process, it should be noted that the level of release agent in the open celled foam pinch roll is generally in equilibrium in that while the impregnated web delivers release agent to the fuser roll on one side the other side is in contact with the foam roll and resupplies release agent to it.

In a preferred embodiment, the Web Assembly is supplied as a specific length of material already impregnated with the proper amount of oil, rolled on a supply spool with a leader already attached to a take up roll. This assembly is installed in the machine. The take up roll is driven by a constant velocity clock motor which has a speed of 1/10 revolution per minute. This information provides the base point to calculate web velocity across the fuser roll.

In accordance with the present invention, it is assumed that the web material wraps the take up roll at a certain rate, thereby increasing its diameter at a known rate, which in turn increases its surface velocity at a predetermined rate. This surface velocity would be the linear velocity of the web at the nip or contact area with the fuser roll. This velocity, at the contact point with the fuser roll, is controlled in accordance with the present invention. In addition, it is necessary to be able to predict when the fuser web material will be expended so it can be replenished before damage has resulted from the lack of release agent.

It has been established that the optimal velocity of the web over the fuser roll, to deliver the appropriate amount of silicone oil, is approximately two millimeters per minute. In general, the control maintains the velocity between 2 and 2.5 millimeters per minute. There are two exceptions where the control velocity is intentionally driven at an increased rate. It should be understood that, although too little oil and too much oil are both unacceptable conditions, the system is more tolerant to an error in the direction of too much oil.

The first exception to the 2 to 2.5 millimeter per minute velocity target is during the initial use of a new web. When a new fuser assembly is first run, the fuser roll needs a breaking in period requiring higher than normal volumes of oil. Also, it is the nature of a new web assembly that the first portion of the web material will not have the volume of oil per area that the rest of the web will contain. Consequently, for these two reasons, a new web will operate at maximum speed for approximately the first 1000 copies of its life.

The second exception to the 2 to 2.5 millimeter per minute velocity target, as already discussed, is during an extended run. Any run exceeding 20 copies (this is the total number of copies between cycle up and cycle down of the machine) will cause the web to run at 150% of velocity up to its maximum velocity. The nature of the fusing system is that during standby, the fuser roll tends to absorb the silicone oil and recover to some extent. During a long run, the fuser roll doesn't enjoy this standby benefit, so the control increases the velocity of the web material over the fuser roll thereby increasing the available release agent for this stress condition.

The web take up roll is driven with a constant velocity clock motor and yet the linear velocity of the web at the nip will increase as the take-up roll diameter increases. Therefore, to maintain a relatively constant or average web velocity at the nip, the duty cycle of the motor most be proportionately decreased. The period of the duty cycle is three (3) seconds and the smallest increment of time the web control algorithm handles is 20 milliseconds, therefore, the velocity can be controlled to within 1 part in 150, up to the maximum velocity (about ⅔ of 1% accuracy). The control tracks the web at the fuser nip by the total accumulated time the web drive motor has been operating. Since web motor time is indicative of the amount of material which has been moved from the supply to the take up spool, and this is indicative of the take up spool diameter, a determination of surface velocity of the take up spool is possible. The total of this accumulated time, which is directly related to velocity, is used for determination of the current duty cycle to control velocity as well as to determine when it is appropriate to declare end of life conditions.

Based on the above, it is possible to control the web to a relatively constant velocity within the ⅔% error margin, although this would create a volume of software control code that would be both unnecessary and unreasonable. It has been demonstrated, therefore, that if the linear velocity of the web, for normal conditions, is controlled to within 2 to 2.5 millimeters per minute, the release performance is adequate and any further precision in the velocity control is unnecessary. Therefore, a limited number of break points have been calculated for the total motor on time, and web motor duty cycle values have been associated with these break points such that the velocity of the web is maintained between 2 and 2.5 mm/minute as shown in FIG. 4.

Figure 4:
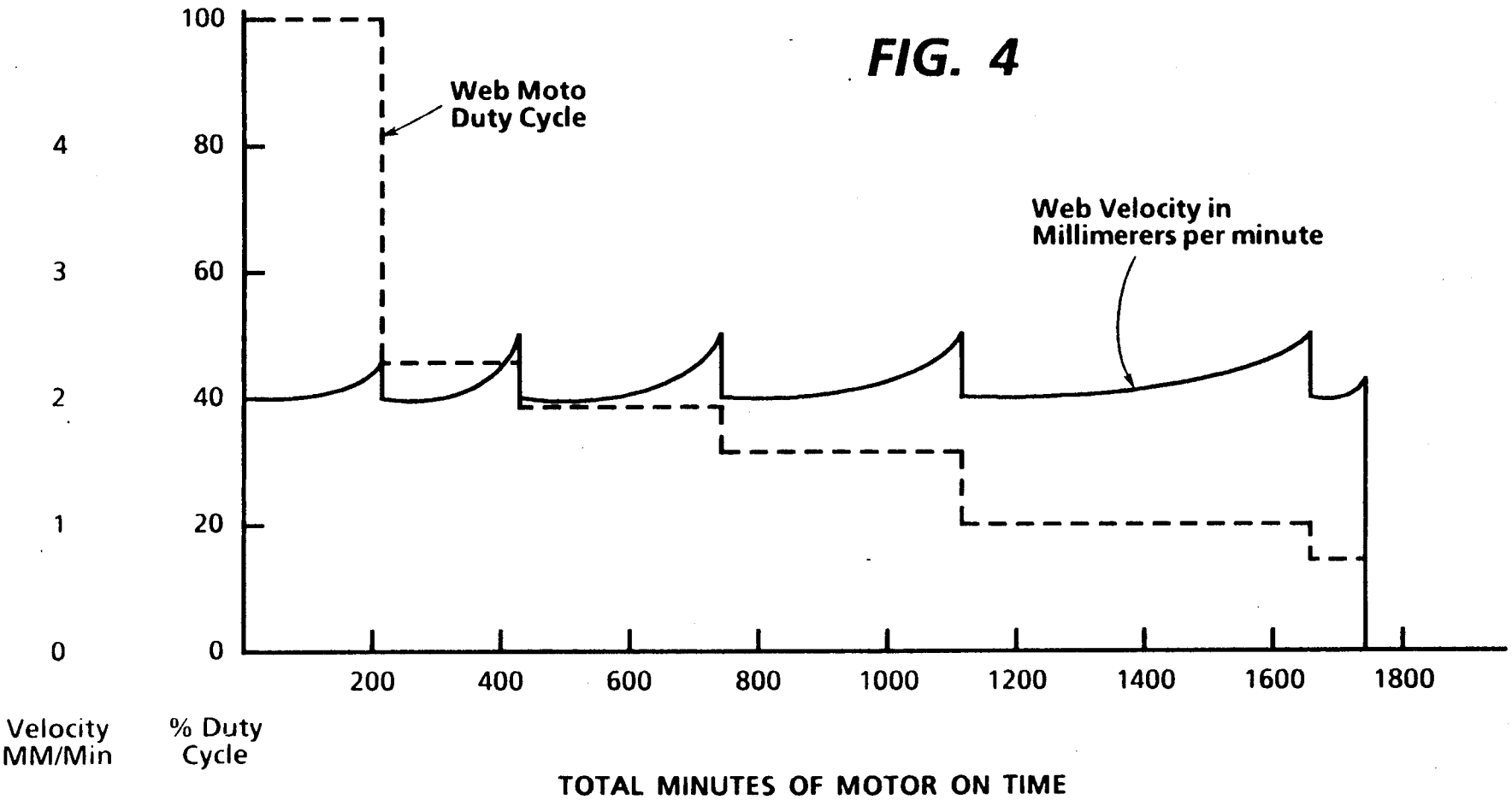
FIG. 4 is an illustration of the web drive duty cycle control in accordance with the present invention.

As shown in FIG. 4, the web motor duty cycle and web velocity in millimeters per minute are plotted as a function of total minutes of motor operation. Thus, initially, the duty cycle (step function shown in dotted lines) is 100%. After 200 cumulative minutes of operation of the motor, the duty cycle is reduced to 47%. After 400 cumulative minutes of operation of the motor, the duty cycle is reduced to 38%. There are stepped reductions of the duty cycle down to 14% duty cycle after 1,640 minutes of total motor operation.

The solid saw tooth appearing curve represents the actual web linear velocity during motor operation. As shown, the web velocity begins to increase toward the end of each duty cycle period due to the increased take-up spool diameter, but that the average of the web velocity remains relatively constant.

In addition, the web motor time indicative of total web consumption has been determined and two points have been determined which will first give a message to the machine control panel indicating the web needs replacement and, if this is not heeded, the machine will be inhibited from operation until the web has been serviced. These messages to the control panel are first an 'L4' which means the web is nearing its end of life. The web will actually be at 99.4% of its calculated life when an 'L4' is displayed. The true end of life is indicated by a U4–6 fault and requires the web to be serviced and the web motor time to be reset before allowing the machine to be functional. Also, an "L4" is displayed in the diagnostics mode at 70% of life. This indication coincides with a visual, red stripe on the web so the technical representative will change the web and likely save a subsequent service call.

The table below shows the web motor time break points and their associated motor duty cycles as well as the break points for the 'L4' and U4–6.

| Total Web Motor On Time | Duty Cycle |
|---|---|
| 0 to 180 minutes | 100% |
| 180 to 422 minutes | 47% |
| 422 to 724 minutes | 38% |
| 724 to 1101 minutes | 30% |
| 1101 to 1640 minutes | 21% |
| 1640 to 1730 minutes | 14% |
| At 1720 minutes | Declare L4 |
| At 1730 minutes | Declare U4–6 |

In a preferred embodiment, three memory bytes or software counters are used to control the duty cycle of the motor. Since a duty cycle period is 3 seconds and the control operates in 20 millisecond increments, a total of 150 twenty millisecond increments equal the 3 second duty cycle period. One of the counters will be loaded with a count of 150 to count down to zero for a full 3 second duty cycle. A second counter is loaded with the count number corresponding to the percentage of duty cycle for the web motor. For example, if a duty cycle of 47% were required, this particular counter would be loaded with a count of 71 corresponding to a 47% duty cycle. When this particular counter has counted down to zero, the motor would then be turned off, thus, effectively providing motor on for approximately 47% of the time. A third counter is a counter to maintain or track accumulative on time of the machine to go to each different increment of duty cycles, for example, from 100% to 47% to 38%, etc..

Thus, initially, at the start of the web, this counter would be loaded with the count of 150 and a count of 150 would be continually added to this counter until adding up to a count of 9,000 or a total time of 180 minutes. This would signify that the beginning of the next operation, the second counter would not receive a count of 150 but rather would be loaded with a count of 71 corresponding to a 47% duty cycle to count down to zero to turn off the motor. In addition, the cumulative counter, of course, would now be incremented by 71 rather than a count of 150, since the cumulative time would increase at only 47% of the rate at 150%. By discretely reducing the duty cycle in steps, as illustrated in the FIG. 4, as the take-up spool or diameter increases, it is possible to maintain a relatively constant velocity of the web at the fuser nip.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

What is claimed is:

1. Apparatus for applying offset preventing liquid to a fuser roll including:

a supply core;

a rotatable take up core;

an oil impregnated web member adapted to be moved from the supply core to the take up core;

a motor for driving the web member from the supply core to the take up core, the motor having a variable duty cycle a pressure roll in engagement with the web member and positioned to provide a contact nip for the web member with the fuser roll opposite the pressure roll wherein the contact of the web member with the fuser roll transfers oil from the web member to the fuser roll, wherein the improvement comprises;

control means to vary the duty cycle of the motor to drive the web member at a relatively constant linear speed at the pressure roll, fuser roll contact nip.

2. The apparatus of claim 1 wherein the motor drives one of the supply core and take up core and wherein the control means alters the duty cycle of the motor in response to the radius of the web member material on the take up roll.

3. The apparatus of claim 2 wherein the control means includes a timer to monitor the cumulative time of operation of the motor and means to progressively decrease the duty cycle of the motor in response to the cumulative time of operation.

4. The apparatus of claim 2 wherein the duty cycle of the motor is in increments of 3 seconds, the motor being either turned on or turned off for a portion of the 3 second increments.

5. Apparatus for applying offset preventing liquid to a fuser roll including: a supply core; a rotatable take up core; an oil impregnated web member adapted to be moved from the supply core to the take up core; a motor electrically connected to the take up core for driving the web member from the supply core to the take up core, the motor having a variable duty cycle, a pressure roll in engagement with the web member and positioned to provide a contact nip for the web member with the fuser roll opposite the pressure roll wherein the contact of the web member with the fuser roll transfers oil from the web member to the fuser roll, and control means to vary the duty cycle of the motor to drive the web member at a relatively constant linear speed at the contact nip, the control means including a timer to monitor the cumulative time of operation of the motor and means to progressively decrease the duty cycle of the motor in response to the cumulative time of operation wherein the progressively decreased duty cycle of operation compensates for the increasing radius of the web member on the take up core to maintain said relatively constant linear speed at the contact nip.

6. The apparatus of claim 5 wherein the control means includes a first counter for loading a number corresponding to the required duty cycle and a second counter for adding the first counter number to accumulate a number corresponding to the total time of operation of the motor.

7. In a device having a supply core, a rotatable take up core, a fuser roll, an oil impregnated web member adapted to be moved from the supply core to the take up core to transfer oil from the web member to the fuser roll, a motor for driving the web member from the supply core to the take up core, and a pressure roll in engagement with the web member and positioned to provide a contact nip for the web member with the fuser roll opposite the pressure roll, the method of maintaining a relatively constant movement of the web member at the contact nip comprising the steps of: driving the motor at a first level of operation, sensing the operation of the motor for a first time period driving the web member from the supply core to the take up core, in response to the sensing of the operation of the motor for said first time period driving the web motor at a second level of operation for a second time period, and, driving the motor at a third level of operation in response to sensing the operation of the motor for said second time period.

8. The method of claim 7 wherein the first, second, and third levels of operation are motor duty cycles related to the speed of movement of the web member at the contact nip.

9. Fuser apparatus for heat fusing toner images to a print substrate comprising a fuser roll and a pressure roll forming a fusing nip therebetween, means to deliver liquid release agent to said fuser roll comprising a movable web supported between a web supply roll and a web take-up roll, the web movable at variable duty cycles, a housing supporting said supply roll and take-up roll such that one of said supply and take-up rolls is on one side of the fuser roll and the other is on the other side of the fuser roll and the movable web is in contact with the fuser roll along a path parallel to its longitudinal axis, said movable web being impregnated with a liquid release agent, said movable web, supply roll and take-up roll being mounted in said housing to deliver liquid release agent to said fuser roll, said movable web being urged into delivery engagement with said fuser roll by a foam pinch roll impregnated with liquid release agent, and including means to advance said release agent impregnated web from said supply roll to said take-up roll at a substantially constant rate to deliver release agent to said fuser roll at a substantially constant rate and including means to advance said web at variable duty cycles.

10. The fuser apparatus of claim 9 wherein said web is advanced at a first duty cycle rate up to a predetermined first measurement number of prints and is advanced at a different duty cycle rate after said predetermined first measurement.

11. The fuser apparatus of claim 10 wherein said web is advanced at a duty cycle rate less than the first duty cycle rate after said predetermined number of prints.

12. The fuser apparatus of claim 9 wherein said web is advanced at progressively decreasing duty cycle rates during the operation of the fuser apparatus.

* * * * *